US009052090B1

(12) United States Patent
Laso et al.

(10) Patent No.: US 9,052,090 B1
(45) Date of Patent: Jun. 9, 2015

(54) SYSTEMS, METHODS, AND DEVICES FOR PROVIDING REPLACEABLE REFLECTOR INSERTS FOR AN LED LIGHT FIXTURE

(71) Applicants: José Antonio Laso, Newnan, GA (US); Smita Anaokar, Smyrna, GA (US)

(72) Inventors: José Antonio Laso, Newnan, GA (US); Smita Anaokar, Smyrna, GA (US)

(73) Assignee: Cooper Technologies Company, Houston, TX (US)

( * ) Notice: Subject to any disclaimer, the term of this patent is extended or adjusted under 35 U.S.C. 154(b) by 97 days.

(21) Appl. No.: 13/828,412

(22) Filed: Mar. 14, 2013

Related U.S. Application Data

(60) Provisional application No. 61/644,233, filed on May 8, 2012.

(51) Int. Cl.
*F21V 17/00* (2006.01)

(52) U.S. Cl.
CPC ..... *F21V 17/002* (2013.01)

(58) Field of Classification Search
CPC ..... F21Y 2101/02; F21Y 2103/003; F21Y 2103/00; F21V 7/0083; F21V 7/00; F21V 13/04; F21V 19/045; F21V 15/01; F21V 19/001; F21V 19/0035; F21V 17/10; F21V 19/0045; F21V 19/003; F21V 17/00; F21V 17/002; F21K 9/30; F21K 9/58; H01L 33/60; F21S 4/003; F21S 48/215; F21S 48/1109; F21S 48/1388; F21S 48/23
See application file for complete search history.

(56) References Cited

U.S. PATENT DOCUMENTS 6,561,689 B1 * 5/2003 Kidd et al. ..... 362/541
2011/0222279 A1 * 9/2011 Kim et al. ..... 362/235

* cited by examiner

*Primary Examiner* — Donald Raleigh
(74) *Attorney, Agent, or Firm* — King & Spalding LLP

(57) ABSTRACT

A light fixture includes a housing that has a first end and a second end. The first end and the second end are opposite each other. The light fixture includes a circuit board that has a light emitting diode (LED). The circuit board is attached to a mounting bracket inside the housing. The light fixture further includes a first reflector insert positioned adjacent to the circuit board on a first side of the circuit board. The first reflector insert is configured to reflect light from the LED. The first reflector insert is removably attached to the first end of the housing and to the second end of the housing.

17 Claims, 6 Drawing Sheets

Reflector attached on ends of fixture

SYSTEMS, METHODS, AND DEVICES FOR PROVIDING REPLACEABLE REFLECTOR INSERTS FOR AN LED LIGHT FIXTURE

RELATED APPLICATIONS

The present application claims priority to U.S. Provisional Patent Application No. 61/644,233, filed May 8, 2012, and titled "Systems, Methods, And Devices For Providing Replacable Reflector Inserts For An Led Light Fixture," the entire content of which is incorporated herein by reference.

TECHNICAL FIELD

The present disclosure relates generally to lighting solutions, and more particularly to systems, methods, and devices for providing replaceable reflector inserts for a light emitting diode ("LED") based light fixture.

BACKGROUND

Some light fixtures include reflector attachments that reflect light from light sources of the light fixture to produce a particular light distribution. Typically, for a set number of light sources of a light fixture attached to a front side of a circuit board, a single piece reflector attachment extends on two sides of the circuit board, and thereby extending on two sides of the light sources. The circuit board and the reflector are also typically attached to a mounting bracket of the light fixture such that a portion of the reflector attachment is positioned between the back side of the circuit board and the mounting bracket. The same fasteners may be used to attach the circuit board and the reflector attachment to the mounting bracket of the light fixture.

In some circumstances, reflector attachments may need to be replaced. For example, the reflector attachments may need to be replaced to change the light distribution from the light fixture. The reflector attachments may also need to be replaced because of diminished effectiveness of the reflector attachments resulting from, for example, damage. Further, reflector attachments may need to be replaced during manufacturing and/or installation. Replacing the reflector attachments typically requires first removing the fasteners that often attach both the circuit board and the reflector attachments to the mounting bracket of the light source. Thus, removing the fasteners results in the decoupling of the circuit board from the mounting bracket. Removing the fasteners from the mounting bracket may be time consuming and costly partly because the removal of the fasteners results in the circuit boards of the light fixture being decoupled from the mounting bracket. Removing the circuit boards may also result in damage to the circuit boards and/or other components (e.g., light sources) of the light fixture. Further, after removing existing reflector attachments, installing replacement reflector attachments that have to be positioned between the circuit board and the mounting bracket may be time consuming and costly.

Thus, light fixture reflector attachments that can be installed adjacent to the circuit board and that do not need to be positioned between the circuit board and the mounting bracket of the light fixture may reduce cost and save time when replacing the reflector attachments.

BRIEF DESCRIPTION OF THE FIGURES

Reference will now be made to the accompanying drawings, which are not necessarily drawn to scale, and wherein.

Figure 1:
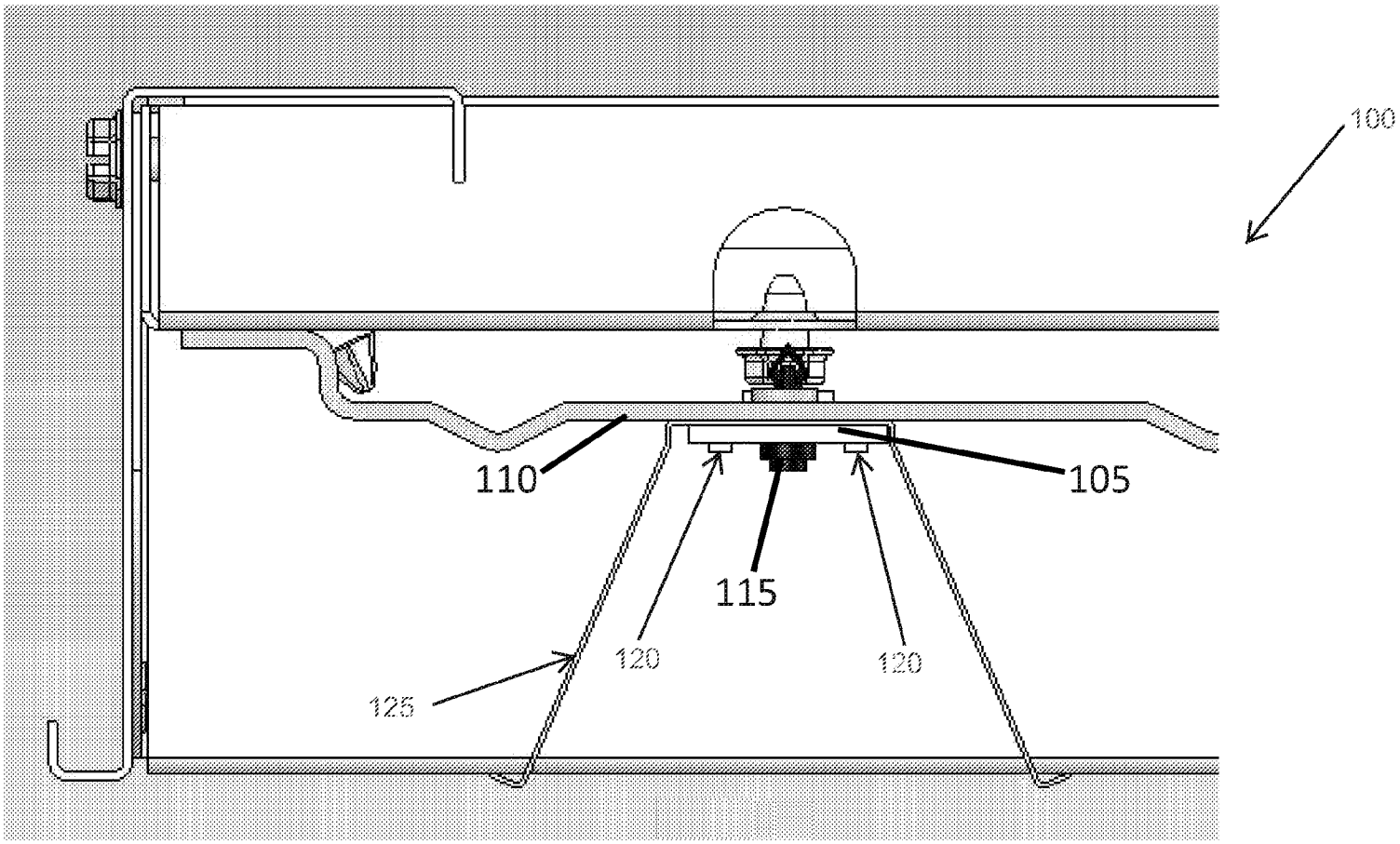
FIG. 1 is a cross-sectional view of an example reflector assembly that is not easily replaceable without disassembling at least part of the light fixture.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

SUMMARY

The present disclosure relates to systems, methods, and devices for providing replaceable reflector inserts for a light emitting diode ("LED") based light fixture. In an example embodiment, a light fixture includes a housing that has a first end and a second end. The first end and the second end are opposite each other. The light fixture includes a circuit board that has a light emit diode (LED). The circuit board is attached to a mounting bracket inside the housing. The light fixture further includes a first reflector insert positioned adjacent to the circuit board on a first side of the circuit board. The first reflector insert is configured to reflect light from the LED. The first reflector insert is removably attached to the first end of the housing and to the second end of the housing.

In another example embodiment, a light fixture includes a housing and a circuit board that has a light emit diode (LED). The circuit board is attached to a mounting bracket inside the housing. The light fixture also includes a first reflector insert positioned adjacent to the circuit board on a first side of the circuit board. The first reflector insert is configured to reflect light from the LED. The light fixture further includes a second reflector insert positioned adjacent to the circuit board on a second side of the circuit board. The second reflector insert is configured to reflect the light from the LED. The light fixture further includes a plurality of brackets attached to the housing. The first reflector insert and the second reflector insert are removably attached to two or more brackets of the plurality of brackets.

In another example embodiment, a method of replacing reflector inserts of a light emitting diode (LED)-based light fixture includes disconnecting at least two incumbent reflector inserts from the LED-based light fixture while leaving an LED board attached to the LED-based light fixture. The method also includes installing at least two new reflector inserts. A first new reflector insert of the at least two new reflector inserts is installed adjacent to the LED board on a first side of the LED board. A second new reflector insert of the at least two new reflector inserts is installed adjacent to the LED board on a second side of the LED board. The first new reflector insert and the second new reflector insert are attached to a first end and a second end of a housing of the LED-based light fixture.

These and other aspects, objects, features, and embodiments will be apparent from the following description and the appended claims.

DETAILED DESCRIPTION OF EXAMPLE EMBODIMENTS

Embodiments are directed to reflector inserts (or accessories) that can be mounted in a light fixture without removing a light emitting diode (LED) light source (e.g., the LED circuit board that includes a plurality of LEDs). The systems and methods described herein may provide several advantages including the ability to quickly and easily change the light distribution in LED source products. Such utilization of these reflector inserts offers the ability to install and/or replace reflector inserts in the field (e.g., during or after installation of the fixture) or even during customization or special processing (or correction) in the fixture manufacturing or assembly process.

Example embodiments will be described more fully hereinafter with reference to the accompanying drawings, in which the example embodiments are shown. The example embodiments should not be construed as limited to the embodiments set forth herein; rather, these example embodiments are provided so that this disclosure will be thorough and complete, and will fully convey the scope of this disclosure to those skilled in the art. Like numbers refer to like, but not necessarily the same or identical elements throughout.

FIG. 1 is a cross-sectional view of an example reflector assembly that is not easily replaceable without disassembling at least part of a light fixture 100. As shown in FIG. 1, the reflector assembly 125 is placed underneath (or between) a mounting bracket 110 and an LED board/substrate 105. The LED board/substrate 105 includes LEDs 120. The reflector assembly 100 and the LED board/substrate 105 are connected to the mounting bracket 110 by a centrally located fastener 115 (e.g., screw, nail, pin, rivet or other mechanical fastener). Because a portion of the reflector assembly 125 is installed between the LED board/substrate 105 and the mounting bracket 110, the fastener 115 passes through the reflector assembly 125. The reflector assembly 125 is held in place by the fastener 115, by the LED board/substrate 105, or both. Regardless of how the reflector assembly 125 is held in place, both installation and removal of the reflector assembly 125 involve the LED board/substrate 105. Such a configuration makes it difficult to replace the reflector assembly 125 (or swap out reflector assemblies) either during installation or after the fixture has been installed.

Figure 2B:
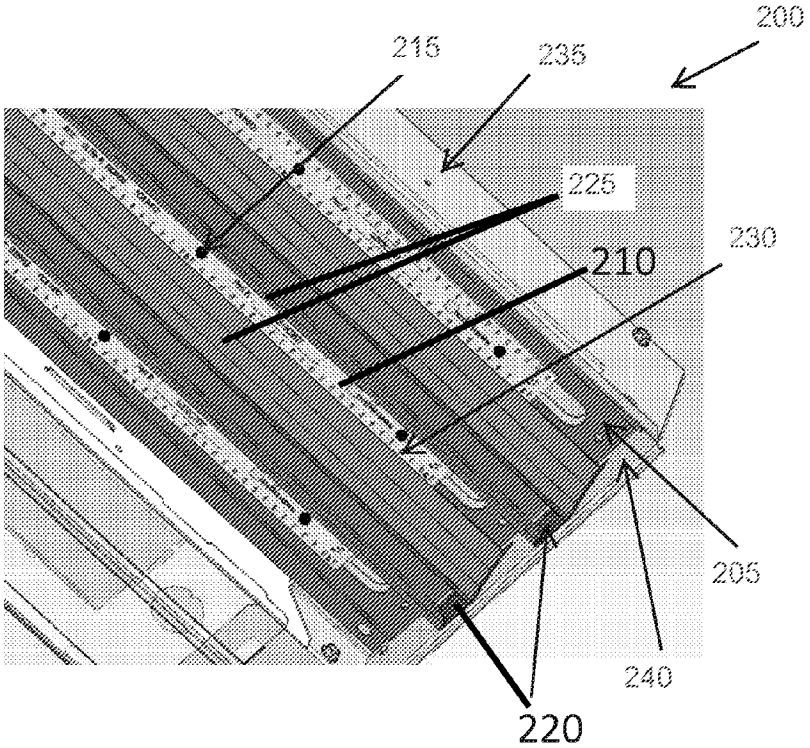
FIG. 2B shows a partial view of the light fixture including the replaceable reflector inserts of FIG. 2A in accordance with an example embodiment.
Figure 2A:
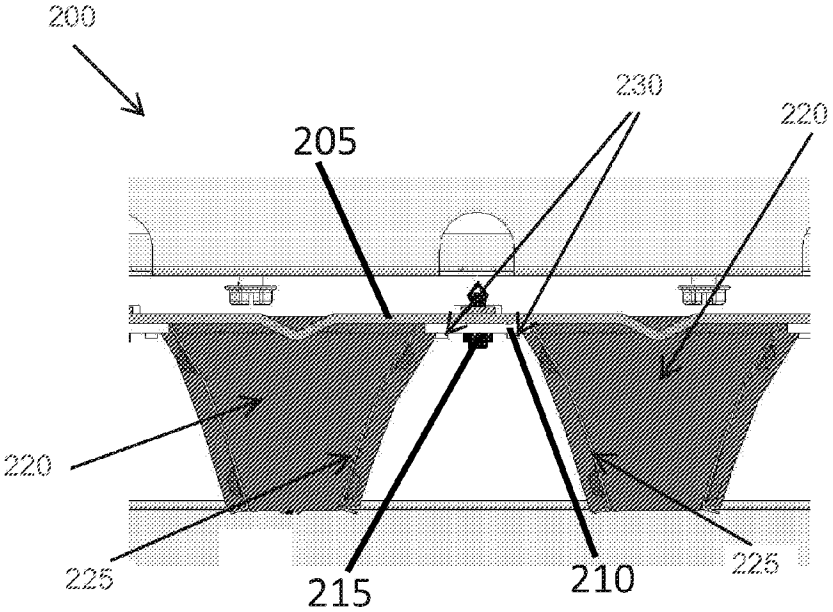
FIG. 2A is a cross-sectional view of a light fixture including replaceable reflector inserts in accordance with an example embodiment.

FIG. 2A is a cross-section of a light fixture 200 including replaceable reflector inserts 225 in accordance with an example embodiment. An LED board/substrate 210 includes a plurality of LEDs 230 positioned on a front side of the LED board/substrate 210. The LED board/substrate 210 is attached to a mounting bracket 205 of the light fixture 200 by a fastener 215. Each of the reflector inserts 225 is configured to reflect light from the plurality of LEDs 230. As shown in FIG. 2A, one of the reflector inserts 225, is positioned adjacent to the LED board/substrate 210 on one side of the LED board/substrate 210. Another one of the reflector inserts 225 is positioned adjacent to the LED board/substrate 210 on another side of the LED board/substrate 210. Neither one of the reflector inserts 225 that are adjacent to the LED board/substrate 210 is attached to the mounting bracket 205 by the fastener 215 or the LED board/substrate 210. As shown in FIG. 2A, the reflector inserts 225 that are adjacent to the LED board/substrate 210 extend out away from each other as the reflector inserts 225 extend further from the LED board/substrate 210. Unlike the light fixture 100 of FIG. 1, the fastener 215 mounting the LED board/substrate 210 to the mounting bracket 205 of the light fixture 200 does not attach the reflector inserts 225 to either the mounting bracket 205 or to another structure of the lighting fixture 200. Instead the reflector inserts 200 are held in place by brackets or are attached to the housing of the light fixture 200, described below with reference to FIG. 2B.

FIG. 2B shows a partial view of the light fixture 200 including the replaceable reflector inserts 225 of FIG. 2A in accordance with an example embodiment. The light fixture 200 includes a housing 235 that has a first end 240. The housing 235 has another end opposite the first end 240. As shown in FIGS. 2A and 2B, the reflector inserts 225 are removably attached to brackets 220 located at the first end 240 and at the opposite end of the light fixture 200. The reflector inserts 225 are mounted to the bracket 220 at the first end 240 and the opposite end such that they surround the LED board/substrate to provide the same light distribution as if the reflector inserts 225 were mounted underneath the LED board/substrate 210.

As illustrated in FIGS. 2A and 2B, in some embodiments, the two reflector inserts 225 that are adjacent to the LED board/substrate 210 are attached to two separate brackets 220 on respective sides of the LED board/substrate 210. The reflector inserts 225 may be attached to the brackets 220 by a fastener, by insertion into slots or channels on the brackets 220, or other means known to those skilled in the art. In some alternative embodiments, the reflector inserts 225 may attach directly to the housing 235 at the first end 240 and at the opposite end of the housing 235 of the light fixture 200. For example, the reflector inserts 225 may slide into a receiving slot or groove located on the housing 235 at the ends of the housing 235. Alternatively, the reflector inserts 225 may snap into corresponding snap fit features located on the housing 235 at the ends of the housing 235.

Because the reflector inserts 225 are not held in place by the LED board/substrate 210 and/or the fastener 215 that attaches the LED board/substrate 210 to the mounting bracket 205, both installation of the reflector inserts 225 in a light fixture and removal of the reflector inserts 225 from a light fixture are simplified, resulting in time and cost savings.

Although each of the reflector inserts 225 shown in FIGS. 2A and 2B has a curvature, in alternative embodiments, the inserts may have other shapes, for example, based on the desired light distribution from the light fixture 200. Further, reflector inserts used in a single light fixture may have different shapes.

Figure 3B:
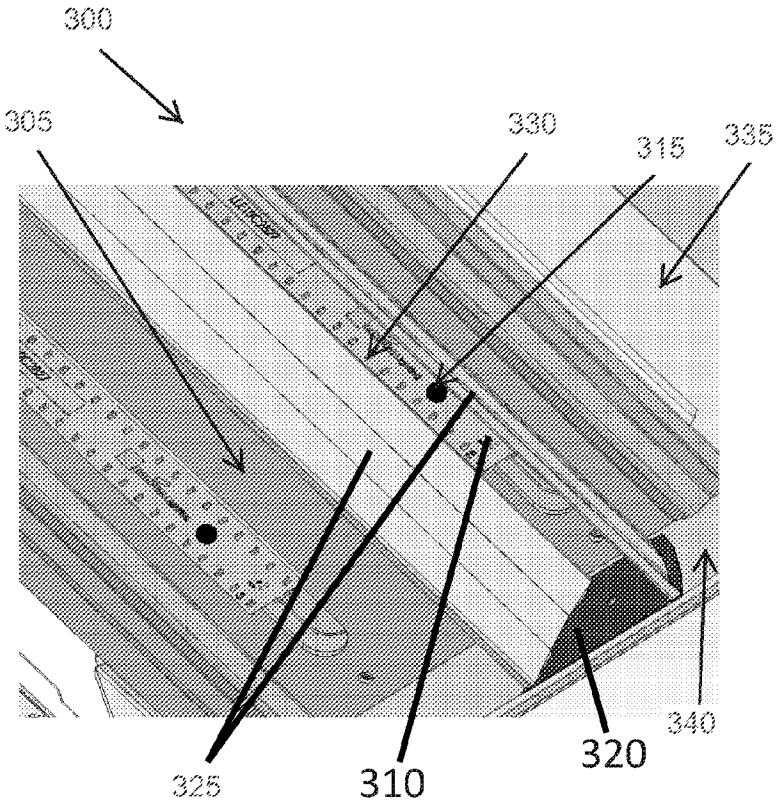
FIG. 3B shows a partial view of the light fixture including the replaceable reflector inserts of FIG. 3A in accordance with an example embodiment.
Figure 3A:
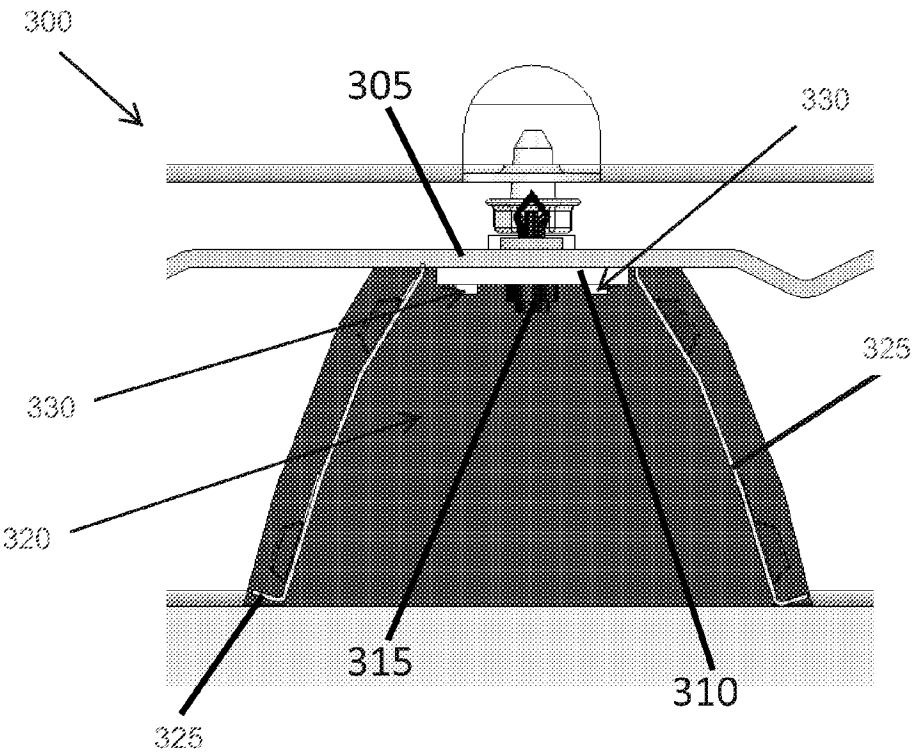
FIG. 3A is a cross-sectional view of a light fixture including replaceable reflector inserts in accordance with another example embodiment.

FIG. 3A is a cross-sectional view of a light fixture 300 including replaceable reflector inserts 325 in accordance with another example embodiment. As shown in FIG. 3A, the reflector inserts 325 are located next to an LED board/substrate 310 that includes LEDs 330. Each of the reflector inserts 325 is configured to reflect light from the LEDs 330.

One of the reflector inserts 325 is positioned on one side of the LED board/substrate 310, and another one of the reflector inserts 325 is positioned on another side of the LED board/substrate 310. Unlike the light fixture 100 of FIG. 1, the fastener 315 mounting the LED board/substrate 310 to the mounting bracket 305 of the light fixture 300 does not attach the reflector inserts 300 to either the mounting bracket 305 or to another structure of the lighting fixture 300. Instead the reflector inserts 325 are held in place by brackets 320 or are attached to the housing of the light fixture 300, as described below with reference to FIG. 3B. The reflector inserts 325 may be installed and removed independent of the LED board/substrate 310 without requiring a prior installation and removal, respectively, of the LED board/substrate 310.

In an example embodiment, the reflector inserts 325 may have a different shape than the reflector inserts 225 of FIGS. 2A and 2B. As a result, the optical distribution associated with the reflector inserts 325 may be different from the optical distribution associated with the reflector inserts 225.

By simplifying installation and removal of reflector inserts, the optical performance of an LED light fixture can be quickly and easily modified at the point of installation or after the fixture has been installed. The simplified processes of removal and installation of the reflector inserts 325 provide the benefit of quickly and easily modifying the optical distribution of the light fixture 300. FIG. 3B shows a partial view of the light fixture 300 including the replaceable reflector inserts 325 of FIG. 3A in accordance with an example embodiment. The light fixture 300 includes a housing 335 and a first end 340.

As shown in FIG. 3B, the reflector inserts 325 are attached to a bracket 320 located at the first end 340 of the housing 335 and another bracket at an opposite end of the light fixture 300. The reflector inserts 325 are mounted to the bracket 320 such that they surround the LED board/substrate 310 to provide the same light distribution as if the reflector insert were mounted under the LED board/substrate 310. The reflector inserts 325 may be attached to the bracket 320 at the first end 340 and to another bracket at an opposite end of the housing in a similar manner described with respect to FIG. 2B. For example, the reflector inserts 325 may be attached to the brackets 320 by a fastener, by insertion into slots or channels on the brackets 320, or other means known to those skilled in the art. In alternative embodiments, the reflector inserts 325 may attach directly to the fixture housing at opposite ends of the fixture, slide into a receiving slot or groove located in the fixture housing, or snap into corresponding snap fit features located in the fixture housing.

Because the reflector inserts 335 are not held in place by the LED board/substrate 310 and/or the fastener 315 that attaches the LED board/substrate 310 to the mounting bracket 305, both installation of the reflector inserts 335 in a light fixture and removal of the reflector inserts 335 from a light fixture are simplified, resulting in time and cost savings.

Figure 4A:
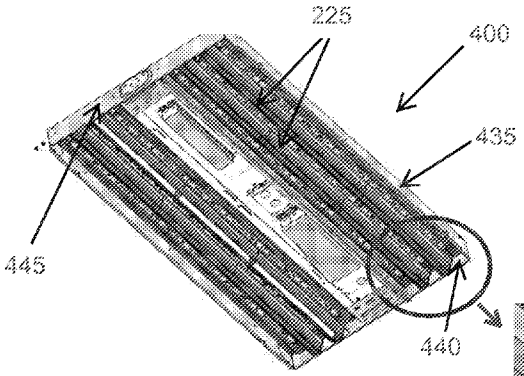
FIG. 4A shows a light fixture including the replaceable reflector inserts of FIGS. 2A and 2B in accordance with an example embodiment.
Figure 4B:
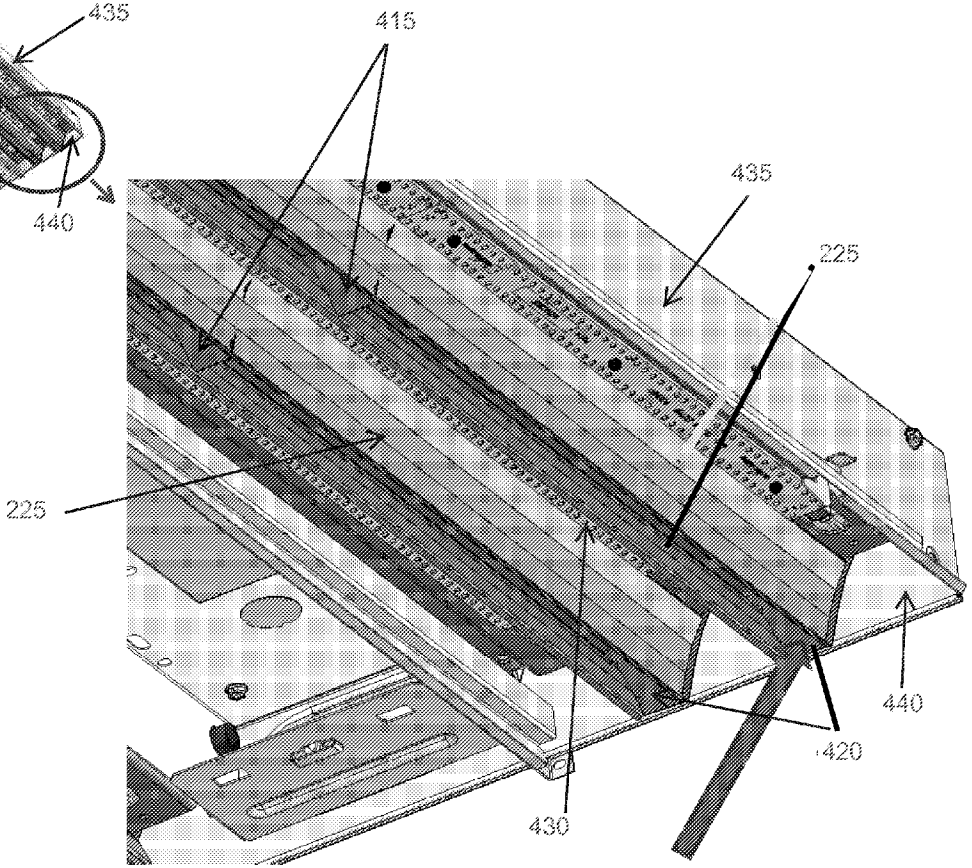
FIG. 4B shows a closer view of an end portion of the light fixture of FIG. 4A in accordance with an example embodiment.

FIG. 4A shows a light fixture including the replaceable reflector inserts 225 of FIGS. 2A and 2B, and FIG. 4B shows a closer view of an end portion of the light fixture in accordance with an example embodiment. Referring to FIGS. 4A an 4B, the light fixture 400 includes a housing 435 that has a first end 440 and a second end 445. The reflector inserts 225 are attached to brackets 420 at the first end 440 and to other brackets at the second end 445. As can be seen in FIGS. 4A and 4B, the reflector inserts 225 are mounted to brackets 420 such that they surround LEDs 430 that are disposed on a front side of an LED board/substrate.

The reflector inserts 225 provide substantially the same light distribution as if the reflector inserts 225 were mounted under the LED board/substrate. Also shown in FIGS. 4A and 4B, the reflector inserts 225 extend the length of the light fixture 400. In alternative embodiments, the reflector inserts extend for the length of the LED boards/substrates or the LEDs 430. In an example embodiment, one or more support brackets 415 may be used between the first end 440 and the second 445 of the housing 435 to provide additional structural rigidity to the reflector inserts 225. In an example embodiment, each one of the reflector inserts 225 provides optical processing for the multiple LEDs disposed on one or more LED boards/substrates, where the LEDs and the one or more LED boards are mounted in an end-to-end relationship in the light fixture 400.

Although the reflector inserts 225 are shown as attached to the brackets 420, in alternative embodiments, the reflector inserts 225 may attach directly to the housing 435 at opposite ends of the fixture (i.e., at the first end 440 and the second end 445). For example, the reflector inserts 225 may slide into a receiving slot or groove located in the fixture housing, or snap into corresponding snap fit features located in the fixture housing.

Figure 5:
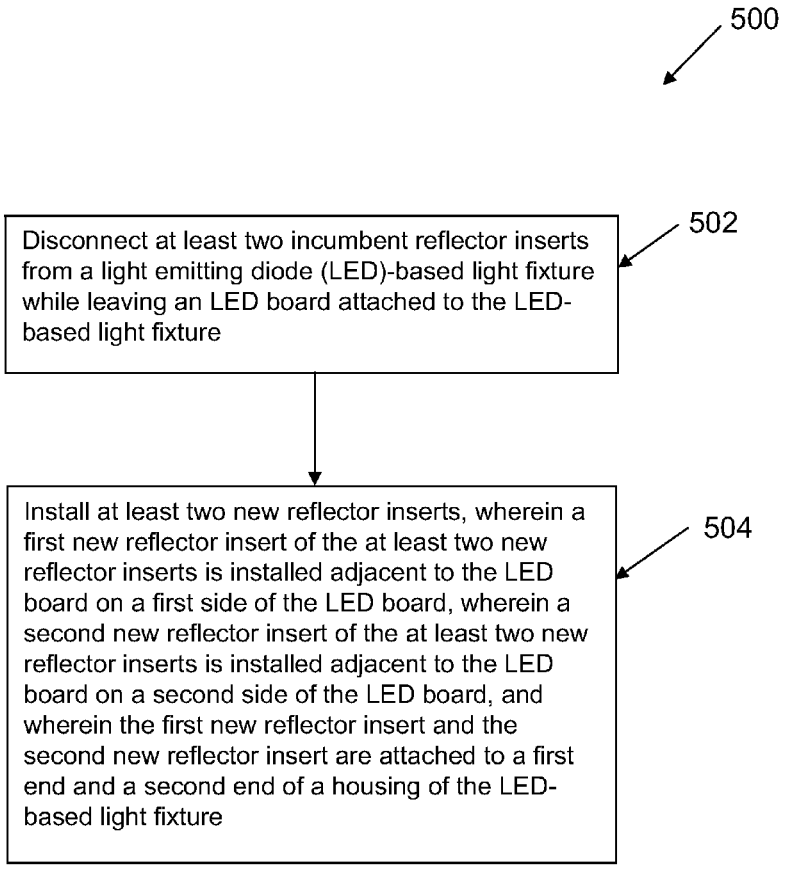
FIG. 5 shows a method for replacing reflector inserts of a light emitting diode (LED)-based light fixture in accordance with an example embodiment.

FIG. 5 shows a method 500 for replacing reflector inserts in an LED-based light fixture. The method 500 includes disconnecting at least two incumbent reflector inserts from the LED-based light fixture while leaving an LED board attached to the LED-based light fixture, at 502. For example, the reflector inserts 225 in FIGS. 4A and 4B may need to be replaced to change light distribution from the light fixture 400 or because of damage to the reflector inserts 225. The reflector inserts 225 may be removed from the light fixture 400, which is an LED-based light fixture, without removing an LED board. The reflector inserts 225 may be removed by removing fasteners used to attach the reflector inserts 225 at the ends of the light fixture 400.

At 504, the method includes installing at least two new reflector inserts. For example, two new reflector inserts that have the same or different shape as the removed reflector inserts 225 may be installed in the light fixture 400 of FIGS. 4A and 4B. The new reflector inserts may be attached to the ends of the housing 435 using the same fasteners that were used to attach the removed reflector inserts 225 or different fasteners. A first new reflector insert of the at least two new reflector inserts may be installed adjacent to the LED board on a first side of the LED board. A second new reflector insert of the at least two new reflector inserts may be installed adjacent to the LED board on a second side of the LED board. The first new reflector insert and the second new reflector insert may be attached to a first end and a second end of a housing of the LED-based light fixture. The new reflector inserts may be attached using brackets at opposite ends of the housing of the light fixture or to the housing itself as described above with respect to FIGS. 2A-4B.

Figure 6:
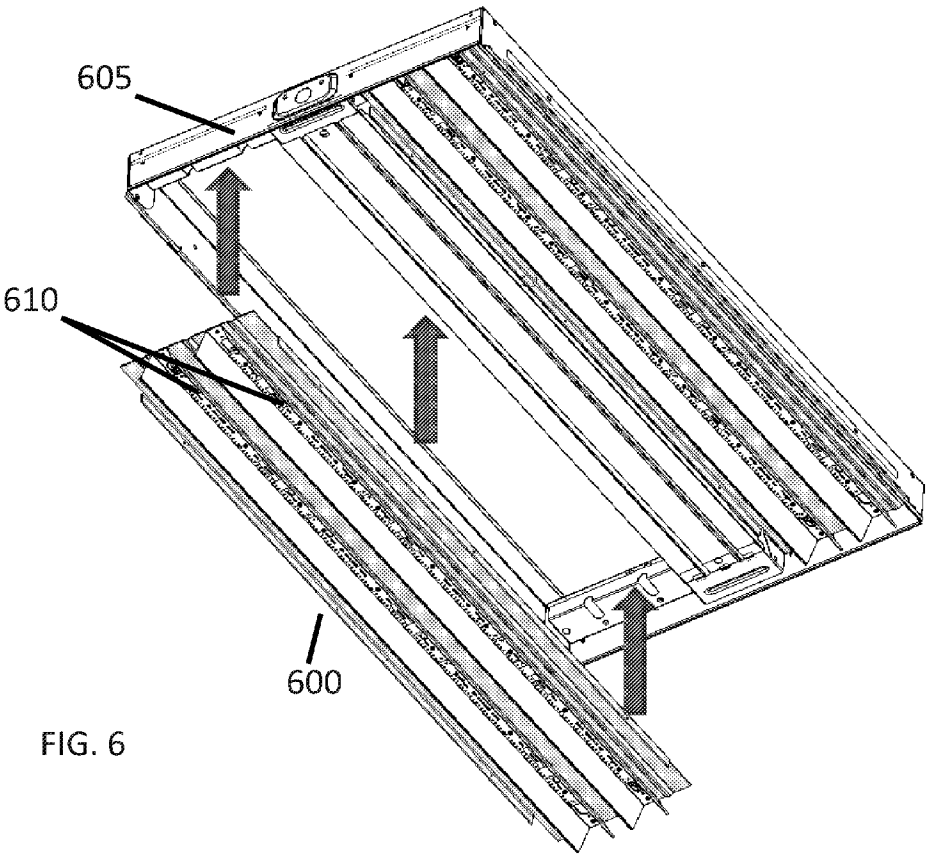
FIG. 6 shows replaceable reflector assemblies that include LED light source components incorporated into the reflector assemblies in accordance with an example embodiment.

FIG. 6 shows replaceable reflector assemblies 600 that include LED light source components (e.g., LED boards) 610 incorporated into the reflector assemblies 600 in accordance with an example embodiment. As shown, in FIG. 6, reflector assemblies 600 may include LED board components 610 including LED boards with LEDs attached to them. Such reflector assemblies 600 may be mounted to a fixture housing 605 at opposite ends of the fixture housing 605 (or along the back of the fixture housing 605) using various fasteners (e.g., screws, clips, magnets, etc.). The reflector assemblies 600 may be used when retrofitting an existing housing already installed in a ceiling, where the internal components of the installed light fixture are removed and the reflector assemblies 600 are installed into the fixture housing 605.

In an alternative embodiment, one or more components of the installed light fixture (e.g., socket tracks, original reflectors, brackets, etc.) are left in the light fixture and the reflector assemblies are installed over such remaining components obstructing the view of such components from below. The reflector assemblies 600 may also enclose (or hide) the electrical components and/or conductors (e.g., driver, wires, controller, etc.) that provide power and/or control to the LED components 610 located on the reflector assemblies 600.

Accordingly, many modifications and other embodiments in addition to those set forth herein will come to mind to one skilled in the art having the benefit of the teachings presented in the foregoing descriptions and the associated drawings. Therefore, it is to be understood that the inventions are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A lighting fixture, comprising:

a housing having a first end and a second end, wherein the first end and the second end are opposite each other;

a circuit board having a light emitting diode (LED), the circuit board attached to a mounting bracket inside the housing;

a first reflector insert positioned adjacent to the circuit board on a first side of the circuit board, the first reflector insert configured to reflect light from the LED, wherein the first reflector insert is removably attached to the housing; and a second reflector insert positioned adjacent to the circuit board on a second side of the circuit board, the second reflector insert and the first reflector insert configured to reflect the light from the same LED, wherein the second reflector insert is removably attached to the housing, wherein the first reflector insert and the second reflector insert are removable from the lighting fixture without removing the circuit board.

2. The lighting fixture of claim 1, wherein the first reflector insert and the second reflector insert extend out away from each other.

3. The lighting fixture of claim 1, wherein each of the first reflector insert and the second reflector insert extends longitudinally along a length of the LED between the first end of the housing and the second end of the housing.

4. The lighting fixture of claim 1, wherein the first reflector insert is positioned into a first receiving slot at the first end of the housing and into a second receiving slot at the second end of the housing, wherein the first end and the second end are opposite each other.

5. The lighting fixture of claim 1, wherein the first reflector insert is snapped into a first snap fit member at the first end of the housing and into a second snap fit member at the second end of the housing, wherein the first end and the second end are opposite each other.

6. The lighting fixture of claim 1, wherein the first reflector insert and the second reflector insert each have a corresponding curvature.

7. A lighting fixture, comprising:

a housing;

a circuit board having a light emitting diode (LED), the circuit board attached to a mounting bracket inside the housing;

a first reflector insert positioned adjacent to the circuit board on a first side of the circuit board, the first reflector insert configured to reflect light from the LED;

a second reflector insert positioned adjacent to the circuit board on a second side of the circuit board, the second reflector insert configured to reflect the light from the LED;

a plurality of brackets attached to the housing, wherein the first reflector insert and the second reflector insert are removably attached to two or more brackets of the plurality of brackets, wherein a first end of the first reflector insert and a first end of the second reflector insert are removably attached to a first bracket of the plurality of brackets at a first end of the housing, and wherein a second end of the first reflector insert and a second end of the second reflector insert are removably attached to a second bracket of the plurality of brackets at a second end of the housing, wherein the first end of the housing and the second end of the housing are opposite each other.

8. The lighting fixture of claim 7, wherein the first reflector insert and the second reflector insert extend out away from each other.

9. The lighting fixture of claim 7, wherein the first reflector insert and the second reflector insert are removably attached by corresponding fasteners.

10. The lighting fixture of claim 7, wherein each of the first reflector insert and the second reflector insert extends longitudinally along a length of the LED between a first end of the housing and a second end of the housing.

11. The lighting fixture of claim 7, wherein the first reflector insert and the second reflector insert are removable from the lighting fixture without removing the circuit board.

12. The lighting fixture of claim 7, wherein a first end of the first reflector insert is removably attached to a first bracket of the plurality of brackets at a first end of the housing, wherein a first end of the second reflector insert is removably attached to a second bracket of the plurality of brackets at the first end of the housing, and wherein a second end of the first reflector insert is removably attached to a third bracket of the plurality of brackets at a second end of the housing, wherein a second end of the second reflector insert is removably attached to a fourth bracket of the plurality of brackets at the second end of the housing, wherein the first end of the housing and the second end of the housing are opposite each other.

13. A method of replacing reflector inserts of a light emitting diode (LED)-based light fixture, the method comprising:

disconnecting at least two incumbent reflector inserts from the LED-based light fixture while leaving an LED board attached to the LED-based light fixture; and installing at least two new reflector inserts, wherein a first new reflector insert of the at least two new reflector inserts is installed adjacent to the LED board on a first side of the LED board, wherein a second new reflector insert of the at the least two new reflector inserts is installed adjacent to the LED board on a second side of the LED board, and wherein the first new reflector insert and the second new reflector insert are each attached to a first end and to a second end of a housing of the LED-based light fixture wherein the first end and the second end are opposite each other.

14. The method of claim 1, wherein the at least two incumbent reflector inserts and the at least two new reflector inserts produce different optical distributions from the LED-based light fixture.

15. The method of claim 13, wherein the at least two new reflector inserts provide optical processing for multiple LEDs disposed on one or more LED boards, and wherein the multiple LEDs are mounted in an end to end relationship in the LED-based light fixture.

16. The method of claim 13, wherein installing the at least two new reflector inserts includes attaching the first new reflector insert to the housing by sliding the first new reflector insert into a first receiving slot on the housing at the first end of the housing and into a second receiving slot on the housing at the second end of the housing.

17. The method of claim 13, wherein installing the at least two new reflector inserts includes attaching the first new reflector insert to the housing by snapping the first new reflector insert into a first snap fit structure at the first end of the housing and into a second snap fit structure at the second end of the housing.

* * * * *